US010080086B2

(12) United States Patent
Lyren et al.

(10) Patent No.: US 10,080,086 B2
(45) Date of Patent: Sep. 18, 2018

(54) DUMMY HEAD THAT CAPTURES BINAURAL SOUND

(71) Applicants: Philip Scott Lyren, Hong Kong (CN); Glen A. Norris, Tokyo (JP)

(72) Inventors: Philip Scott Lyren, Hong Kong (CN); Glen A. Norris, Tokyo (JP)

( * ) Notice: Subject to any disclaimer, the term of this patent is extended or adjusted under 35 U.S.C. 154(b) by 0 days.

(21) Appl. No.: 15/253,948

(22) Filed: Sep. 1, 2016

(65) Prior Publication Data

US 2018/0063641 A1 Mar. 1, 2018

(51) Int. Cl.
*H04R 5/027* (2006.01)
*H04S 7/00* (2006.01)

(52) U.S. Cl.
CPC ..... *H04R 5/027* (2013.01); *H04S 7/303* (2013.01); *H04R 2420/07* (2013.01); *H04S 2420/01* (2013.01)

(58) Field of Classification Search
CPC ..... H04R 5/027; H04R 5/04; H04R 2420/07; H04S 7/303; H04S 2420/01
USPC ..... 381/26
See application file for complete search history.

(56) References Cited

U.S. PATENT DOCUMENTS 4,741,035 A * 4/1988 Genuit ..... H04R 5/027 381/26
2014/0198918 A1* 7/2014 Li ..... H04S 7/30 381/26

OTHER PUBLICATIONS

Algazi et al.; "The CIPIC HRTF database"; Oct. 21-24, 2001.*
G.R.A.S Sound and Vibration; "45BB KEMAR Head and Torso"; Apr. 16, 2013.*
Carpentier et al.; "Measurement of a head-related transfer function database with high spatial resolution"; Dec. 23, 2015.*

* cited by examiner

*Primary Examiner* — David Ton

(57) ABSTRACT

A dummy head has facial features that resemble a human face and includes a microphone inside a left ear and a microphone inside a right ear. A configuration of the facial features of the dummy head changes to enable the dummy head to capture binaural sound with different head related impulse responses (HRIRs).

5 Claims, 3 Drawing Sheets

DUMMY HEAD THAT CAPTURES BINAURAL SOUND

BACKGROUND

Three-dimensional (3D) sound localization offers people a wealth of new technological avenues to not merely communicate with each other but also to communicate with electronic devices, software programs, and processes.

As this technology develops, challenges will arise with regard to how sound localization integrates into the modern era. Example embodiments offer solutions to some of these challenges and assist in providing technological advancements in methods and apparatus using 3D sound localization.

SUMMARY

Figure 1:
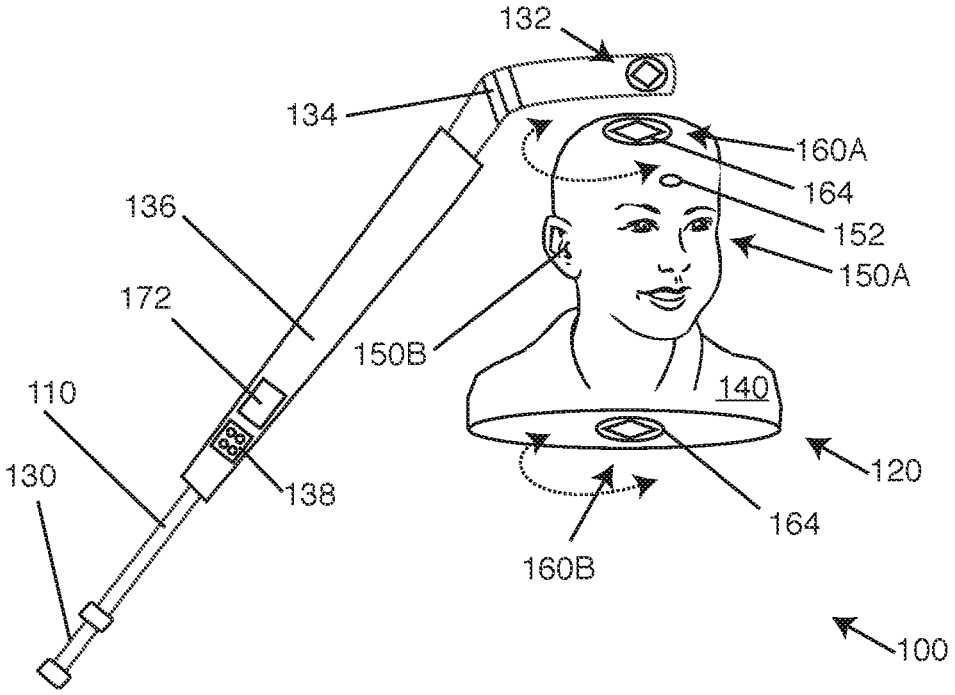
FIG. 1 is a system that captures binaural sound and includes a pole and a dummy head in accordance with an example embodiment.

One example embodiment is a dummy head with facial features that resemble a human face. The dummy head includes a microphone inside a left ear and a microphone inside a right ear. A configuration of the facial features of the dummy head changes to enable the dummy head to capture binaural sound having different head related impulse responses (HRIRs).

Other example embodiments are discussed herein.

DETAILED DESCRIPTION

Example embodiments include method and apparatus relating to capturing binaural sound with a dummy head and torso. The dummy head and torso can function as a stand-alone unit or attach to an elongated boom or pole. Further, a configuration of the dummy head can be changed in order to capture different head related impulse responses (HRIRs).

One technical problem is that a dummy head can only capture a single set of HRIRs. A different dummy head is required for each unique set of HRIRs. Example embodiments solve this problem and others.

One example embodiment provides a dummy head with a configuration that can change. For example, the dummy head has removable portions or sections, such as removable eyes, ears, nose, face, etc. These portions can be removed and replaced with differently sized and/or shaped portions to change HRIRs the dummy head captures. The dummy head can also have a generic shape, such as an oval or head shape with no distinct facial features, generic facial features, or no facial features. A removable face can be placed and attached to the dummy head to capture specific or individualized HRIRs that depend on the features of the removable face.

Consider two example uses of the dummy head for the benefit of a listener whose head matches or resembles the dummy head. In one example use, binaural sound captured at the dummy head can produce externally localized sound for the listener. For instance, the dummy head captures binaural sound with its two microphones, and this sound is provided to the listener so the listener can hear 3D audio captured by the dummy head. As another example use, the dummy head captures HRIRs with dual microphones. A software program and hardware calculate head related transfer functions (HRTFs) and execute the HRTFs to convolve sound for the listener to produce sound that externally localizes to the listener.

Another problem is that dummy heads can be expensive to manufacture and are not adapted to connect with different electronic and mechanical devices. Example embodiments solve these problems and others.

An example embodiment provides a dummy head that is disposable or inexpensively and quickly made. For example, the dummy head is made from a 3D printer, made as a shell or hollow, and/or made with removable electronic components.

Further, an example embodiment includes a dummy head that removably connects to a boom or pole at different locations. The dummy head can also removably attach to different torsos. In this manner, a single dummy head can mix and match with different torsos or different components to capture binaural sound with a large variety of HRIRs. Further, the dummy head can be made to emulate, copy, or resemble a specific individual and capture user-specific HRIRs to produce HRTFs for this individual or produce binaural sound that can be provided to the listener with no further processing or convolving.

FIG. 1 shows a system 100 that captures binaural sound. The system includes a pole or boom 110 that removably connects to a dummy head 120.

The elongated pole or boom 110 includes a first end with a hand grip 130 and a second end with a connector 132 that connects to one or more dummy heads 120. The pole can include one or more joints or hinges 134 about which the second end of the pole can rotate, swivel, or move. The pole 110 also includes a sound-absorbing sheath or cover 136 or can be made from a material that does not interfere with binaural sound capture. The pole can also include other electrical connectors 138, such as an audio-out jack, headphone jack, power connector, and others. Furthermore, the pole can be fabricated from a lightweight material (such as aluminum or carbon fiber) and have an adjustable length (such as a telescoping pole). The shape of the pole can be adjusted or bent.

In an example embodiment, the dummy head 120 can include a torso 140. This torso can be a partial torso (such as stopping above the chest as shown in FIG. 1) or a full torso that extends below the chest. Furthermore, the dummy head can be a head without a torso (such as stopping at or along the neck). For illustration, the figures show a dummy head with a partial torso.

In an example embodiment, the dummy head can tilt and rotate independent of the torso. For example, the head and torso system can be configured in a posture in which the head faces toward the left (−90°) or right side (90°) of the torso or toward the left or right shoulder, and/or the head can be tilted back (180°) or forward (0°) as though looking upward or downward, or cocked or listing to the left (−90°) or right (90°). For example, the dummy head has a freedom of motion with respect to the torso that matches the freedom of motion of a human head and neck. Head tilt and rotation configuration allows HRIR capture for configurations in which, for example, the torso is fixed, but the head is movable (e.g., a pilot fastened in a cockpit whose head can move to look left, right, or up).

In an example embodiment, the dummy heads and torsos are made to copy, approximate, resemble, emulate, or represent a head and torso of a person. The head and torso can have generic or non-descript human features (such as eyes, ears, nose, hair, chin, etc.) or have specific human features so as to resemble an actual person (such as a dummy head that looks like a real person) or have a general circular or oval shape (e.g., with a smooth surface with limited or no facial features). A size and shape of the dummy head and torso can copy, approximate, resemble, emulate, or represent a size and shape of a head and torso of a human person, including a specific individual. In this manner, the dummy head can look like a specific human being.

In an example embodiment, the dummy head has a size of a human head with generic or non-descript features. For example, the dummy head has an oval or round shape that is neither male nor female. A facial cover is placed over or fits on the head and provides the dummy head with a face that copies, resembles, emulates, or represents a human face. For instance, the facial cover is made of silicone, rubber, pliable polymer, paper, moldable material, or other pliable, bendable, or shapeable material that can fit on or over the dummy head and provide it with realistic human facial features. As another example, the facial cover is made of rigid plastic or polymer that removably connects to the dummy head.

Figure 2:
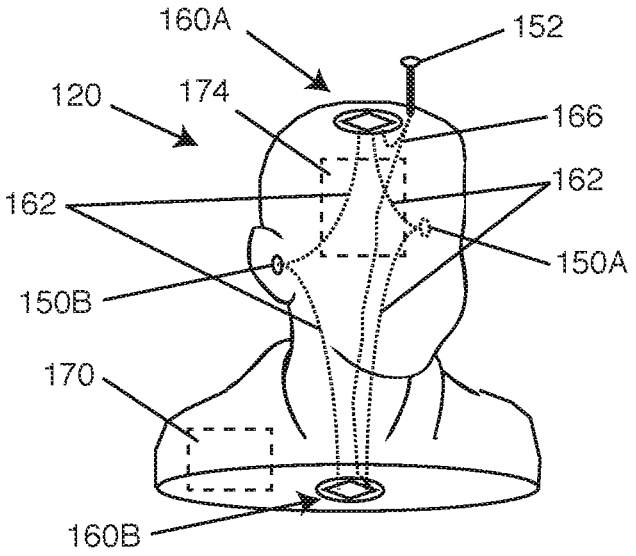
FIG. 2 is the dummy head of FIG. 1 with portions removed to illustrate internal electronics and connections in accordance with an example embodiment.

FIG. 2 shows the dummy head 120 with facial portions removed to illustrate internal electronics and connections.

Looking to FIGS. 1 and 2, the dummy head 120 includes a pair of microphones that are positioned near or inside ears of the dummy head. A left microphone 150A captures sounds at the left ear, and a right microphone 150B captures sounds at the right ear. These two microphones capture binaural sound and can be positioned or built on, near, or inside the ears of the dummy head.

The dummy head can include an additional reference microphone 152 that records and captures a mono signal. Sound can be captured from the pair of microphones 150A and 150B, and simultaneously by the reference microphone 152. The reference microphone 152 can be flush mounted as shown in FIG. 1 or extended away from the head as shown in FIG. 2. The reference microphone can capture a room impulse response (RIR) of the environment for the captured binaural sound at the time of the binaural capture and at the location and orientation of the binaural capture. The RIR can be removed from the binaural capture at a later time or in real-time in order to deliver a dry or more anechoic binaural capture.

By way of example, the dry binaural capture can be useful in situations where the RIR of the capture does not match the listening conditions of the listener. For example, the dummy head is in an echoic space with high reverberation, and (1) the dummy head is being used to capture telephone call audio, but the listener is at a remote location with low or different reverberation, or (2) the dummy is being used to capture binaural audio for later inclusion in a soundtrack where the action does not take place in the same environment as the capture, or (3) the listener is in a virtual reality (VR) environment, and the RIR of the VR environment is anechoic or different than the RIR of the room with the dummy head.

In the examples above, the listener provided with a dry binaural capture can perceive more realistic localization without the distraction, disorientation, or reverberation artifacts from RIRs that do not match the location, position, or orientation of the listener. For example, the listener can perceive as false, RIRs that result from walls or objects present at the location of the dummy head, but not in the environment of the listener (such as during a phone call or using augmented reality (AR)), or in the listener's perceived environment (e.g. a listener watching a video, or in VR). Further, by providing a dry binaural capture, different RIRs can be added to and convolved with the dry binaural capture for the benefit of the listener. For example, the dry binaural capture can be convolved with the RIR of the environment and/or position/orientation of the listener, or the RIR of the environment that the listener is perceiving visually (e.g. watching a video or in VR).

Consider an example in which a listener binaurally captures with an electronic device voices during a meeting with several people in an echoic conference room. Later while traveling in an airplane, the listener replays the recording of the meeting to review it. The listener desires to perceive the localization of the persons at the meeting in order to distinguish who is speaking, but the listener does not want to hear the acoustic cues of the size and shape of the meeting room environment. Instead, the listener wants to hear the content of the speech and the localization of the speakers. This listener can benefit from hearing the capture with the RIR of the meeting room removed from the capture.

The captured RIR can also be convolved with other sound that is added to or appended to the binaural capture at a later time. Consider an example of a phone call from a listener to a remote party that includes the dummy head, two human people, and an online intelligent personal assistant (IPA) not using a loudspeaker. The listener will understand that the two people speaking are in the same room with the dummy head because the RIRs of the voices of the two people will match. The listener, however, will hear the voice of the online IPA without a RIR, so the listener can detect that the IPA is online and without a physical presence in the room. The captured RIR can be convolved with the voice of the IPA so that the listener can hear the IPA as though the IPA is speaking in the room with the two people.

Looking back to FIGS. 1 and 2, the dummy head 120 includes two mechanical and/or electrical contacts 160A and 160B that removably mechanically and/or electrically connect with contacts 132 of the pole 110 or other electronic and/or mechanical connectors. A first contact 160A is located on a head (such as a top side or a back side) of the dummy head, and a second contact 160B is located on a base, bottom, or torso side of the dummy head. As such, the dummy head and torso can connect to the pole on either the bottom side or the top side. These connectors can be quick-connect/disconnect connectors for electrical and/or mechanical connection.

In one example embodiment, electrical wires 162 extend from the microphones in each of the ears to both contacts 160A/160B on the bottom side and the top/back side, and electrical wires 166 extend from the reference microphone 152 to both contacts 160A/160B. These wires can connect to a recording or sound capturing apparatus in order to transfer the sound captured from the microphones to a sound recording apparatus (such as a recording apparatus worn or held by an operator or included in or attached to the pole, dummy head, or torso) or telephony device.

The connectors 160A/160B can serve one or more functions that include providing electrical power to the dummy head and/or torso, providing audio input/output signals to/from the dummy head and/or torso, and providing a mechanical connection with the dummy head and/or torso.

The connectors at the pole, dummy head, and torso enable the dummy head and torso to move or rotate through a variety of positions. The connectors can include, couple to, be in communication with, or be adjacent to a mechanism 164 that enables the dummy head to rotate, such as about a platform, base, or the torso. By way of example, the mechanism 164 can be a swivel, a gimbal, a pivot, a ball-n-socket, or other motor or manual assisted rotatable connection.

For example, the dummy head is able to rotate about (e.g., 0°-360°), and move along, three separate axes (such as X-axis, Y-axis, and Z-axis; or yaw axis, roll axis, and pitch axis). Furthermore, as noted, the pole can adjust or bend to accommodate different bends or angles. These movements or the connectors and/or pole enable the dummy head to be positioned to a multitude of different angles to capture binaural sound in many different positions and orientations.

In one example embodiment, the dummy head can include electronics 174, such as one or more of a controller or processor, a memory, one or more lights (such as light emitting diodes, LEDs), a display, left and right microphones, a user interface (such as a network interface, a graphical user interface, a natural language user interface, a natural user interface, a phone control interface, a reality user interface, a kinetic user interface, a touchless user interface, an augmented reality user interface, and/or an interface that combines reality and virtuality), a wireless transmitter/receiver, et al. For example, the left and right microphones capture binaural sound, the reference microphone captures sound, and the electronics wirelessly transmit the sounds to an electronic device (such as a remote computer, smartphone, audio recorder, server, etc.).

In one example embodiment, the pole or dummy head includes a motor 170 (such as an electric or battery powered motor) to move the dummy head to the different positions and orientations. For example, the motor can be controlled with an interface or control 172 located on the pole. The interface can be included on the dummy head, such as being part of or in communication with the electronics 174. As another example, the motor can be wirelessly and/or remotely controlled through commands received from an electronic device (such as commands received from a computer in wireless communication with the electronics in the dummy head and/or pole). As another example, the motor and dummy head are attached to an Unmanned Aerial Vehicle (UAV) such as a quadcopter or radio controlled multi-rotor copter or "drone."

In one example embodiment, a user can control movement of the dummy head with verbal commands or gestures, such as verbal commands to the user interface on the dummy head. For example, verbal commands instruct the dummy head to rotate about one or more axes while connected to the pole and capturing binaural sound or while being a standalone device.

Figure 3:
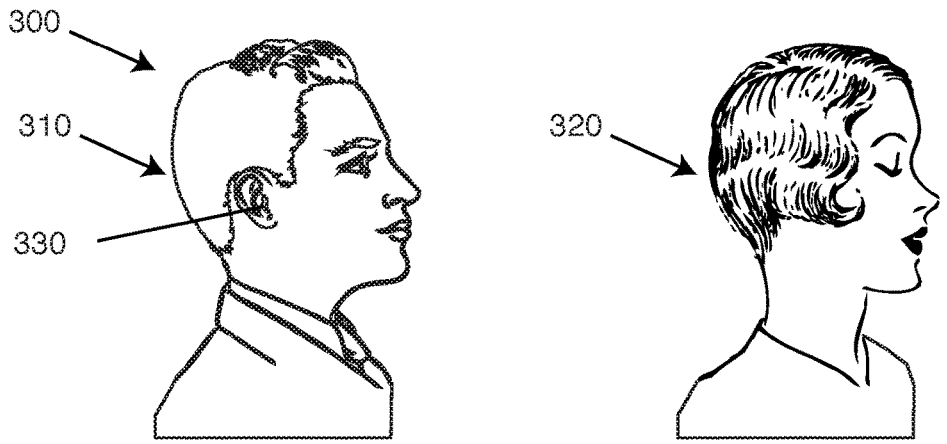
FIG. 3 a system with a plurality of different dummy heads and/or torsos that are interchangeable and connectable with each other and/or with different poles in accordance with an example embodiment.

FIG. 3 is a system 300 with a plurality of different dummy heads and/or torsos 310 and 320 that are interchangeable and connectable with each other and/or with different poles. For illustration, a male head 310 and a female head 320 are shown, but the system can include other types of dummy heads and/or torsos discussed herein. For example, the system 300 includes multiple male dummy heads and multiple female dummy heads. These heads can have different shapes and sizes to capture different head related impulse responses (HRIRs). Furthermore, these heads can be removably connected to different torsos in order to enable a user to mix different heads with different torsos. Furthermore, the heads and torsos can be dressed (e.g., with hair, clothing, eyeglasses, helmets, headphones, fashion/safety/technology/assistive accessories, etc.) in order to capture a variety of specific HRIRs.

HRIRs/HRTFs are related to the physical attributes of the size and shape of the head and torso. Different combinations of heads and torsos thus result in different HRIRs. A combination of head and torso can range in specificity from generically human to the likeness and dress of a specific individual. Within this range a user can control or change a type or category of HRIRs to capture. By way of example, these categories can include, but are not limited to, male, female, child, adult, thin, muscular, etc. The categories can also be related to region, ethnicity, or other factors, such as Caucasian featured (such as size, shape, and spacing of eyes, nose, chin, pinnae, brow, etc.), Asian featured, Pacific Islander featured, Tibetan featured, etc. For example, if an intended audience is adult Swedish females, then the head and torso can be provided as a generic adult female Swede-looking head and torso. HRIRs resulting from these physical attributes can provide more accurate sound localization for more members of the audience than by using a face and torso of a different shape.

Figure 4:
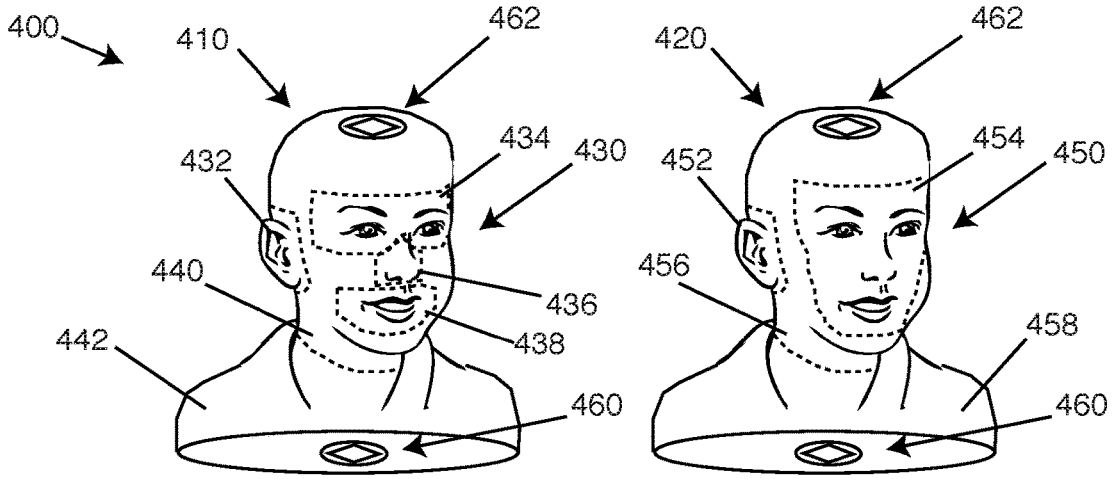
FIG. 4 is a system with a plurality of different dummy heads and/or torsos with pieces, portions, or components that are removable and interchangeable and connectable with each other in accordance with an example embodiment.

FIG. 4 is a system 400 with a plurality of different dummy heads and/or torsos 410 and 420 with pieces, portions, or components that are removable and interchangeable and connectable with each other. The dummy heads 410 and 420 are formed of multiple pieces or sections, such as a left ear section, a right ear section and a face section that removably connect to a base section or support section (e.g., a section that serves as a head without the ears and a face or a section to which the removable components attach). The face section can further include a removable nose and mouth.

These different sections of ears, face, and/or nose/mouth attach to the base section or support section to enable a user to construct different sizes and shapes of heads and faces onto the base section. These different sizes and shapes of heads capture different HRIRs to produce different HRTFs. In this manner, a single base section with plural removable components can produce a multitude of different HRTFs and HRIRs.

These different sections of the head mechanically connect and/or lock together with a removable connection so they can be assembled and disassembled to change a look or appearance of the dummy head. Assembled dummy heads can include one or more of the different sections. For example, a dummy head can be assembled that includes a support or base and ears but does not include a face. As another example, different support or base sections provide heads with different shapes, widths, lengths, or diameters that, in effect, produce different impulse responses when capturing binaural sound with the microphones. As such, users can quickly and easily change a size and shape of a dummy head to capture binaural recordings with different HRIRs.

Consider an example in which a remote listener is listening to binaural sound being captured by the dummy head in a configuration with a first face-plate component, and the listener's ability to externally localize sound sources in the room is evaluated. As the listener continues to listen, the first face-plate is replaced by a second face-plate, and the listener's ability to externally localize sound sources in the room is again evaluated. By trying different component assemblies and combinations, an optimal combination can be found according to the firsthand observations of and immediate feedback from the listener.

By way of example, dummy head 410 includes a left ear section 430, a right ear section 432, an eye section 434, a nose section, 436, and a mouth section 438 that removably connect to a removable head 440. The head 440 removably connects to a base or torso section 442.

By way of example, dummy head 420 includes a left ear section 450, a right ear section 452, and a face section 454 that removably connect to a removable head 456. The head 456 removably connects to a base or torso section 458.

Bottoms of the torsos 442 and 458 include electrical and/or mechanical connectors 460, and tops of the torsos include electrical and/or mechanical connectors 462. Further, these bottoms are flat so the torsos and head can rest on a surface and maintain the head in the configured position. For example, the torso can be positioned on the ground, a desk, a table or other surface when not connected to a pole in order to capture binaural sound. For instance, the torsos can remain upright and in a level position since the bottom is flat.

In one example embodiment, individual facial features are interchangeable. For example, two dummy pinnae modeled from a specific person are mounted on a clip or headband that can be then mounted on the dummy head, or on another object with dimensions and/or density similar to a human head, in order to match or approximate the effect of acoustic shadowing of a human head. The pinnae can be printed or molded or prepared such that the microphone fits in a gap or notch or canal at the location of the ear canal opening of the dummy pinnae. In this way, dummy ears that include the microphones securely fitted inside can be moved from one dummy head or object to another.

Consider an example in which Bob is on a video phone call with Alice, and requests to see the left ear of Alice. Upon exposing her left ear, software operating on Bob's smartphone analyzes the image of the ear to create a virtual 3D model of the left ear, and a mirror transformation of the left ear model to serve as a virtual 3D right ear model. Bob's 3D printer prints the two ears at life-size scale. Bob inserts left and right microphones into the ear models and mounts them on a dummy head that rests on his desk. He continues the conversation with Alice and uses the microphones on the dummy head to capture his voice. Alice can localize the voice of Bob from her point of perception at the dummy head.

The dummy head can operate without the boom and/or torso and can be used for real-time telephony. For example, a dummy head is placed on a user's desk, captures binaural sound from a speaking person during a telephone call, and plays audio to the speaking person through loudspeakers located in the dummy head or in communication with the dummy head. The dummy head can also function as a headphone stand or headphone holder (e.g., when a user stores headphones on the head of the dummy head).

The dummy head can also include removable microphones in the ears or built-in microphones in the ears. When the user removes the headphones from the dummy (for example, to wear on himself), a sensor is triggered that activates the microphones in the dummy head, and deactives other microphones that may be active.

Consider an example in which Bob sits at a desk and receives a call alert from Alice. He lifts the headphones from the dummy and wears them in order to hear Alice. A sensor 330 (shown in FIG. 3) on the dummy 310 registers the removal of the headphones, activates or couples the headphones to the telephony device and application, and enables the microphones on the dummy. Thereafter Alice hears Bob from the location and orientation of the dummy head, and Bob hears Alice from the speakers in the headphones. Alice says she can't hear Bob well, so Bob moves the dummy closer, and faces it toward himself.

Prior to the call, Bob can mic-through the sound captured from the dummy into the headphones he is wearing. For example, Bob speaks to the dummy head so that he can test the sound level and localization position of his voice and other sounds in the room. When Bob speaks, he can hear his own voice as if he were at the position of the dummy. For example, Bob is concentrating on a computer task looking at his computer monitor on his desk, and his associate approaches from behind and addresses Bob from a standing position behind Bob's chair. Bob is irritated to converse with someone standing at his back, so he lifts the headphones from the dummy, wears the headphones, and points the dummy head to face the associate who is speaking. Bob continues to sit facing the screen but Bob now localizes the voice of the associate to a point above the computer monitor on his desk.

As mentioned above, a dummy head with one or more motors can be remotely controlled. Consider an example in which a motorized dummy head is placed on a table in a conference room while a conference is being held. The dummy head captures voices and sounds in the room and provides this binaural sound to the caller. The caller remotely controls the rotation of the dummy head and can rotate the dummy head to face the person speaking. Alternatively, a voice sensor can automatically rotate the dummy to face the speaking person. Alternatively, the dummy is mobile and free roaming in the room (such as on wheels or UAV), and the caller or another person or software program can control the location and orientation of the dummy head in the room so that the caller also perceives the audial experience of free roaming in the room.

The dummy heads and/or torsos can be made from a lightweight material, such as one or more of foam, wood, plastic, polymer, aluminum, paper, or another material so they are portable or moveable. Further, a user or operator can easily hold the dummy head (with or without a torso) with less mass and can more easily maneuver the dummy head when it is attached to or held on a pole. The dummy heads and/or torsos can be inflatable. The dummy heads can also include a weight in a base or a heavier base or torso so the dummy torso can remain in a fixed position while the head rotates. The dummy heads and/or torsos can be produced by a 3D printer from a model resulting from a 3D scan of a user's head and torso, from photo or video images, or from other sources of information.

Further, the dummy heads can be permanent or disposable. For example, a 3D printed dummy head is printed as a hollow or empty head with a thin outer structure. In this manner, the dummy head can be printed relatively quickly and inexpensively, and microphones placed in the ears to capture binaural sound. Consider an example in which the thin structure is wrapped around or envelopes a featureless, stock, or generic head shape, or portions of the head or face or features are 3D printed and mounted to a base head having a density similar to or matching a human head density.

Consider an example in which a user provides or transmits to a friend a 3D image, one or more pictures or photos, or computer model of his head and/or face. With this information, the 3D printer of the friend prints a 3D dummy head that copies or simulates the head of the user. The dummy head printed by the friend is positioned over a base or stand (or stands on its own), and left and right microphones are positioned in the ears of the dummy head. When the user places a telephone call to the friend, the friend speaks to the dummy head (printed in the likeness of the user) that, in turn, captures binaural sound in the room with the friend, such as the friend speaking and other sound sources having a higher frequency than speech. This sound can be provided directly to the user with little or no convolving. As such, the user can receive sound during the telephone call that is already captured per his/her head related impulse responses since the dummy head copies or simulates the head of the user. Alternatively, the user transmits or provides his or her HRTFs or HRIRs to convolve the friend's voice prior to transmission to the user.

Binaural sound can also be captured with scale models, such as small-scale models (e.g., a dummy head that is smaller than a human head). Impulse responses can be adjusted to compensate for air attenuation and other factors, and the sound can be adjusted to extend the dynamic range. Consider the example above in which the model is printed at 1:8 scale, and the captured sounds (e.g. the high frequencies) are processed before being heard by the listener. Small-scale models can be printed faster than life-size models, use less material, and are easier to transport and store.

The dummy heads can have various configurations and offer a variety of different uses and interchangeability. For example, the dummy heads can be standalone (without a torso), attached to and removed from a torso, attached to and removed from a pole, single units, part of system of removable components, etc. The torso also includes one or more electrical and/or mechanical connectors that communicate with the electronics and/or microphones.

The dummy heads and torsos provide a mobile system that facilitates convenient capture of binaural sound. Furthermore, the system enables a user to capture and/or create different types of HRIRs/HRTFs according to the dummy heads and torsos that are connected. An example embodiment thus provides a user with flexibility in capturing and transmitting binaural sound with individualized transfer functions and/or impulse responses.

Consider an example in which a boom operator attaches a dummy head to an end of the boom pole to capture binaural sound while filming a movie. The boom pole is an elongated pole made of aluminum or carbon fiber and can be extendable, such as a telescopic pole. Microphones in the ears of the dummy head capture binaural sound or dialogue on the movie set while the head is fixed, or while in motion through the set. The dummy head and/or torso can be fixed or may tilt and/or rotate during the shot. During shooting of the film, the boom operator attaches the pole to the top of the dummy head, and lowers the head into the scene. In another scene, the boom operator attaches the boom to the back or bottom of the head and raises the head into the scene. Attachment to the top, back, or bottom of the dummy head enables the boom operator to have flexibility to maneuver the dummy head into a correct position for sound capture.

Consider another example in which a dummy head and torso are not connected to a boom pole but function as a standalone unit. The head and torso are movable to different positions to capture binaural sound. For example, the head and torso function as a stand-in actor or actress and capture dialogue (in the form of binaural sound) while another actor recites his or her lines to the stand-in actor, which in this case is the dummy head and torso. For instance, the dummy head detaches from the pole and attaches to a torso or base unit with a flat bottom that enables the dummy head to stand firm on a flat surface.

Multiple heads and torsos can be positioned around a movie set to capture binaural sound at different locations. Each of these locations offers a different audio point-of-view or binaural listening point of a listener. Listeners are thus able to hear the audio in binaural sound from a different location as if they were present at the location from the point-of-view of the position and orientation of the dummy head and torso. In this manner, films can provide listeners with multiple different sound options that enable listeners to hear the sounds sources in the film from different locations in the scene or from different points-of-view in the scene. These different listening points provide the users with a wider array of audio experiences for the film or video or 3D visual experience, such as a game or 3D telecommunication.

Consider an example in which one or more motors control the six degrees of freedom of the dummy head, and a listener or other person controls the motors using gesture commands or commands based on head movement. For example, the commands are obtained from corresponding movements of the head of the listener. The head gestures match the degree of freedom, direction, and magnitude of the listener's desired change in the position and orientation of the dummy head. For example, the listener desires to rotate the position of the dummy head at the remote location 45° to the left and tilt the dummy head +15° elevation. The listener rotates his own head 45° to the left and tilts his head 15° upwards as the gesture commands, and these commands cause the motors to rotate and tilt the dummy head according to the gestures. For example, the listener's head position and orientation are tracked (e.g., with a gyroscopic sensor attached to the listener's head, or software that analyzes images or video of the listener's head and interprets head position changes). The motors cause the dummy head to match the changes or match the new position of the listener's head orientation.

Consider the example above in which the movements of the dummy are triggered by and mimic the gestures of an avatar or 3D representation of a person in VR. For example, the head of an avatar rotates −20°, and this rotation causes a −20° rotation of the dummy head. The avatar can be controlled by or mimic the movements of a person, or the avatar movements can be directed by a computer program.

Consider further an example in which a computer program triggers and controls the movements of the dummy head and torso. For example, a dummy head and torso mounted with a front-facing video camera are placed in a room with multiple different sound sources, and a computer program controls the movement of the dummy. A remote stationary listener who can also see the video from the camera can localize the multiple sound sources and can determine the locations of the sound sources in the room. Although the dummy head can change orientation, causing the externalized sound sources to move relative to the head of the listener, the listener can make sense of moving sound sources because he or she can see the corresponding video from the dummy indicating the changing orientation of the dummy head. For example, the listener is provided with both an audial and visual first-person point-of-view of the dummy head. This point-of-view allows the listener to determine the locations of the sound sources in the room even as the dummy moves.

Consider an example in which the dummy head and torso are attached to a mobile platform, such as wheels or unmanned aerial vehicle (UAV), and maneuvered into a dangerous area such as an abandoned damaged nuclear power facility or mine in order to inspect the environment. The listener is able to hear and localize the position of audible signals that can be difficult to detect with video (e.g. a radioactive coolant dripping in a dark corner) so that the location can be further inspected. The remote controlled dummy head can be mounted in a cockpit so that a remote pilot familiar with important audible signals such as alerts or creaking can move the dummy head to determine the source of sounds that do not appear on video or telemetry. Consider another dangerous environment such as a riotous or combat zone. A dummy head modeled from a human peacekeeper can be maneuvered in order to localize important sound sources.

Consider an example embodiment of a system that captures binaural sound. The system includes an elongated pole and a dummy head. The elongated pole has a first end that includes a handle and a second end that includes a connector. The dummy head has a front side with a human face and includes a microphone at a left ear, a microphone at a right ear, a first connector that electrically connects to the microphone at the left ear and the microphone at the right ear and that is located on a back side of the dummy head that is opposite to the front side with the human face. The connector of the pole mechanically connects to the first connector to hold the dummy head at the second end of the pole and electrically connects to the first connector to receive binaural sound captured with the microphone at the right ear and the microphone at the left ear. The dummy head includes a torso having a shape of a human torso and includes a second connector that electrically connects to the microphone at the left ear and the microphone at the right ear. The second connector is located on a bottom side of the dummy head that is underneath the torso or underneath the neck.

Further, the dummy head includes a wireless transmitter that transmits the binaural sound captured with the microphones to another electronic device, such as a remote electronic device.

In an example embodiment, the human face is removable from the dummy head and is replaceable with another human face that fits on the dummy head to capture the binaural sound with different head related impulse responses. Further, a dummy head can include multiple removable sections, such as two, three, or more removable portions that include the left ear, the right ear, and the front side with the human face. Changing or replacing one of these sections with a different section changes what HRTFs/HRIRs the dummy head captures.

Figure 5:
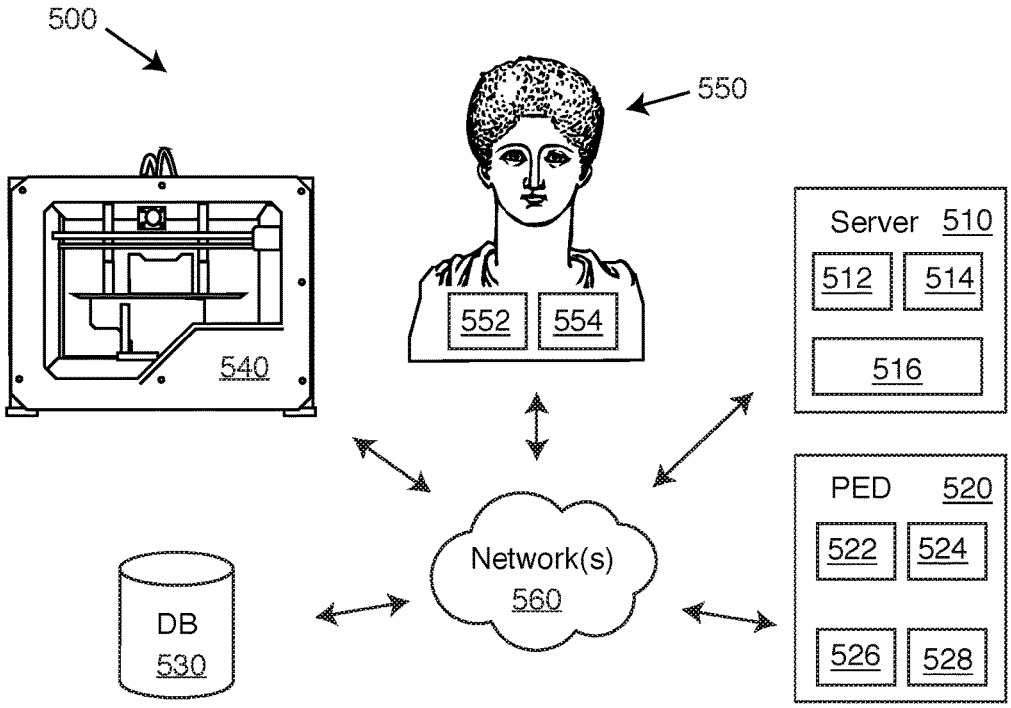
FIG. 5 is an electronic system in accordance with an example embodiment.

FIG. 5 is an electronic system 500 in accordance with an example embodiment. The electronic system 500 includes a server 510, a portable electronic device (PED) 520, a database 530, a 3D printer 540, and one or more dummy heads 550 that communicate over one or more networks 560.

The server 510 includes a processor or processing unit 512, memory 514, and dummy head software 516 (such as software to execute one or more example embodiments discussed herein).

The portable electronic device 520 includes a processor or processing unit 522, memory 524, display 526, and dummy head software 528 (such as software to execute one or more example embodiments discussed herein).

The database 530 stores data and/or information to assist in executing example embodiments, such as storing HRIRs/HRTFs (or other transfer functions or impulse responses for people and/or dummy heads), facial features or head images for people and/or dummy heads, and other information.

The 3D printer 540 can receive information from electronic devices in the system 500 to print dummy heads, portions of heads, and torsos.

The dummy head 550 includes one or more of a motor 552 and electronics 554 to enable movement of the dummy head. For example, the dummy head software 516/528 communicates with the motor 552 and/or electronics 554 to control movement of the dummy head, executes communication with the dummy head, transmission and capture of binaural sound, and other functions discussed herein in accordance with example embodiments.

The network 560 can include one or more of a cellular network, a public switch telephone network, the Internet, a local area network (LAN), a wide area network (WAN), a metropolitan area network (MAN), a personal area network (PAN), home area network (HAM), and other public and/or private networks. Additionally, the electronic devices need not communicate with each other through a network. As one example, electronic devices can couple together via one or more wires, such as a direct wired-connection. As another example, electronic devices can communicate directly through a wireless protocol, such as Bluetooth, near field communication (NFC), or other wireless communication protocol.

The processor or processing unit 512/522 includes a processor (such as a central processing unit, CPU, digital signal processor (DSP), microprocessor, microcontrollers, field programmable gate arrays (FPGA), application-specific integrated circuits (ASIC), etc.) for controlling the overall operation of memory (such as random access memory (RAM) for temporary data storage, read only memory (ROM) for permanent data storage, and firmware). The processing units and/or digital signal processor (DSP) communicate with each other and memory and perform operations and tasks that implement one or more blocks of the flow diagram discussed herein. The memory, for example, stores applications, data, programs, algorithms (including software to implement or assist in implementing example embodiments) and other data.

The processor or processing unit 512/522 can include a digital signal processor (DSP). For example, a processor or DSP executes a convolving process with the retrieved HRIRs (or other transfer functions or impulse responses) to process sound so that the sound is adjusted, placed, or localized for a listener.

For example, the DSP converts mono or stereo sound to binaural sound so this binaural sound externally localizes to the user. The DSP can also receive binaural sound and move its localization point, add or remove impulse responses (such as RIRs), and perform other functions.

For example, an electronic device or software program convolves and/or processes the sound captured at the microphones of the dummy head and provides this convolved sound to the listener so the listener can localize the sound and hear it. The listener can experience a resulting localization externally (such as at a sound localization point (SLP) associated with near field HRTFs and far field HRTFs) or internally (such as monaural sound or stereo sound).

Sounds can be provided to the listener through speakers, such as headphones, earphones, stereo speakers, etc. The sound can also be transmitted, stored, further processed, and provided to another user, electronic device or to a software program or process (such as an intelligent user agent, bot, intelligent personal assistant, or another software program).

Figure 6:
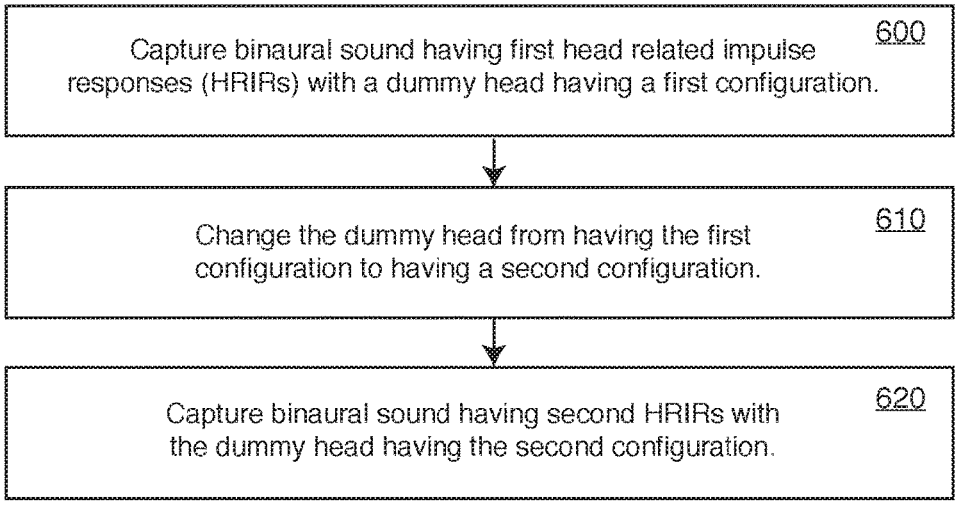
FIG. 6 is a method to capture binaural sound with a dummy head in accordance with an example embodiment.

FIG. 6 is a method to capture binaural sound with a dummy head.

Block 600 states capture binaural sound having first head related impulse responses (HRIRs) with a dummy head having a first configuration (e.g., a first shape and/or size and/or orientation).

The dummy head includes a microphone in or at the right ear and a microphone in or at the left ear that capture binaural sound. A first configuration of the dummy head enables the microphones to capture binaural sound having a first set of head related impulse responses (HRIRs).

The configuration of the dummy head affects the HRIRs. Parameters of this configuration that effect the HRIRs include, but are not limited to, size and/or shape of the ears, nose, torso, head, chin, mouth, cheeks, hair, and face, position and orientation of the head and/or torso.

Block 610 states change the dummy head from having the first configuration to having a second configuration.

The configuration of the dummy head is changed to effect the HRIRs being captured. In order to alter the resulting HRTFs/HRIRs, one or more of the parameters that effect HRTFs/HRIRs are changed. For example, one or more of the following are replaced or changed or altered or removed: size and/or shape of the ears, nose, torso, head, chin, mouth, cheeks, hair, and face, position of the dummy, orientation of head relative to torso.

Additionally, an entire dummy head can be changed or altered. For example, a first dummy head that resembles a woman is removed from a torso or base and replaced with a second dummy head that resembles a man.

Block 620 states capture binaural sound having second HRIRs with the dummy head having the second configuration.

A change to a feature of the dummy head changes HRIRs that are captured. For example, replacing the ears on the dummy with differently sized and shaped ears will effect HRIRs captured by the microphones located in or at these ears.

Example embodiments can reduce inventory of dummy heads, save on cost of purchasing different dummy heads, expedite capturing/calculation of different HRIRs/HRTFs, reduce space required for storing dummy heads, decrease time needed to capture different HRIRs, assist in capturing/creating individualized HRIRs/HRTFs, and provide a wealth of other advantages.

With an example embodiment, a single dummy head can capture a multitude of different HRIRs. A separate dummy head for each individual set of HRIRs is not required. Instead, a dummy head in accordance with an example embodiment can change one or more of its physical features to capture a different or unique set of HRIRs according to the physical features.

Consider an example method that captures binaural sound with a dummy head. A dummy head has a microphone in a right ear and a microphone in a left ear to capture binaural sound having a first set of head related impulse responses (HRIRs) from the dummy head with a first configuration. The microphones in the right and left ears capture binaural sound having the first set of HRIRs of the first configuration. The right ear of the dummy head is replaced with a different right ear, and the left ear of the dummy head is replaced with a different left ear. These changes to the left and right ears change or alter the dummy head to having a second configuration to capture a second set of HRIRs that are different than the first set of HRIRs. The microphones in the right and left ears capture binaural sound having the second set of HRIRs of the second configuration. In this manner, a single dummy head can provide multiple different sets of HRIRs/HRTFs.

In an example embodiment, a system includes the dummy head with a set of differently sized and shaped right ears that removably attach to the dummy head and a set of differently sized and shaped left ears that removably attach to the dummy head in order to change HRIRs that the dummy head captures with microphones located in the right and left ears.

The system can also include multiple faces or other removable components that are removable from the dummy head and replaceable with different components. For example, the faces are made from a pliable, elastic material, such as silicon, rubber, or polymer. These faces fit on or wrap around the dummy head and provide unique facial features (including ears) that in turn provide unique HRIRs/HRTFs. In this manner, a single dummy head (such as an oval or head-shaped one can receive different faces and provide different sets of HRIRs of captured binaural sound, and in turn, different sets of HRTFs for providing binaural sound without a dummy head.

Consider an example in which a dummy head includes generic features or features that are not particular to an individual. A user prints (e.g., with a 3D printer) components (e.g., ears, a nose, and/or face) that resemble or copy facial features of the user and attaches these components to the dummy head. These components transform the dummy head from having generic features to having specific features of the user. In this specific configuration, the dummy head will capture HRIRs similar to the impulse responses that would occur if the user's head were in the same location.

Consider another example in which a user (Alice) obtains a picture of her friend (Bob). The picture (or pictures) include sufficient information to extract facial features of Bob, such as sizes and shapes of his ears, nose, head, and face. With this information, Alice prints a mask, shell, or cover that looks like the face of Bob and places this printed object on a dummy head that includes microphones in the ears. During a telephone call with Bob, Alice speaks to the dummy head that captures binaural sound. This binaural sound transmits to Bob so he hears the telephone call as if he were present with Alice.

In some example embodiments, the methods illustrated herein and data and instructions associated therewith, are stored in respective storage devices that are implemented as computer-readable and/or machine-readable storage media, physical or tangible media, and/or non-transitory storage media. These storage media include different forms of memory including semiconductor memory devices such as DRAM, or SRAM, Erasable and Programmable Read-Only Memories (EPROMs), Electrically Erasable and Programmable Read-Only Memories (EEPROMs) and flash memories; magnetic disks such as fixed and removable disks; other magnetic media including tape; optical media such as Compact Disks (CDs) or Digital Versatile Disks (DVDs). Note that the instructions of the software discussed above can be provided on computer-readable or machine-readable storage medium, or alternatively, can be provided on multiple computer-readable or machine-readable storage media distributed in a large system having possibly plural nodes. Such computer-readable or machine-readable medium or media is (are) considered to be part of an article (or article of manufacture). An article or article of manufacture can refer to a manufactured single component or multiple components.

Blocks and/or methods discussed herein can be executed and/or made by a user, a user agent (including machine learning agents and intelligent user agents), a software application, an electronic device, a computer, firmware, hardware, a process, a computer system, and/or an intelligent personal assistant. Furthermore, blocks and/or methods discussed herein can be executed automatically with or without instruction from a user.

What is claimed is:

1. A system that captures binaural sound, comprising:

a base shaped as a human torso and including a wireless transmitter and a connector;

a plurality of dummy heads each including a different human face, a microphone located in a right ear and coupled to the wireless transmitter, a microphone located in a left ear and coupled to the wireless transmitter, and a neck with a connector that engages the connector of the base such that the dummy heads fit on top of the base, wherein the microphone located in the right ear and the microphone located in the left ear capture binaural sound, and the wireless transmitter transmits the binaural sound to an electronic device remote from the base; and a boom with a connector located at one end, wherein each of the plurality of dummy heads includes a mechanical connector located on a head of the dummy heads and that removably connects to the connector at the end of the boom.

2. The system of claim 1 further comprising:

a plurality of left ears that each have a different shape and that removably connect to the dummy heads; and a plurality of right ears that each have a different shape and that removably connect to the dummy heads.

3. The system of claim 1 further comprising:

a motor located in the base that rotates the dummy head with respect to the base in order to capture the binaural sound from different azimuth angles.

4. A system that captures binaural sound comprising:

a base shaped as a human torso and including a wireless transmitter and a connector;

a plurality of dummy heads each including a different human face, a microphone located in a right ear and coupled to the wireless transmitter, a microphone located in a left ear and coupled to the wireless transmitter, and a neck with a connector that engages the connector of the base such that the dummy heads fit on top of the base, wherein the microphone located in the right ear and the microphone located in the left ear capture binaural sound, and the wireless transmitter transmits the binaural sound to an electronic device remote from the base; and a plurality of faces each having a different shape that resembles a different human face and that removably connects to the dummy heads.

5. A system that captures binaural sound, comprising:

a base shaped as a human torso and including a wireless transmitter and a connector; and a plurality of dummy heads each including a different human face, a microphone located in a right ear and coupled to the wireless transmitter, a microphone located in a left ear and coupled to the wireless transmitter, and a neck with a connector that engages the connector of the base such that the dummy heads fit on top of the base, wherein the microphone located in the right ear and the microphone located in the left ear capture binaural sound, and the wireless transmitter transmits the binaural sound to an electronic device remote from the base, and wherein each of the dummy heads has three removable components that include a removable right ear, a removable left ear, and a removable face and the three removable components are interchangeable and connectable to the dummy heads to create human heads with different features to capture different head related impulse responses (HRIRs).

* * * * *